US007579045B2

(12) United States Patent
Rock et al.

(10) Patent No.: US 7,579,045 B2
(45) Date of Patent: Aug. 25, 2009

(54) COMPOSITE FABRIC WITH ENGINEERED PATTERN

(75) Inventors: Moshe Rock, Brookline, MA (US); Douglas Lumb, Atkinson, NH (US); Charles Haryslak, Marlborough, MA (US); Gadalia Vainer, Melrose, MA (US)

(73) Assignee: MMI-IPCO, LLC, Lawrence, MA (US)

( * ) Notice: Subject to any disclaimer, the term of this patent is extended or adjusted under 35 U.S.C. 154(b) by 131 days.

(21) Appl. No.: 11/236,247

(22) Filed: Sep. 27, 2005

(65) Prior Publication Data

US 2006/0040059 A1 Feb. 23, 2006

Related U.S. Application Data

(62) Division of application No. 10/700,405, filed on Nov. 4, 2003.

(51) Int. Cl.
*B05D 5/00* (2006.01)

(52) U.S. Cl. ..... 427/288; 427/285; 427/261

(58) Field of Classification Search ..... None
See application file for complete search history.

(56) References Cited

U.S. PATENT DOCUMENTS

| | | | |
|---|---|---|---|
| 2,774,074 | A | 12/1956 | Lehmann |
| 2,962,384 | A | 11/1960 | Ljungbo |
| 3,654,019 | A | 4/1972 | Cusick |
| 3,703,730 | A | 11/1972 | Miller |
| 3,739,400 | A | 6/1973 | Colehower |
| 3,776,768 | A | 12/1973 | Weitzel et al. |
| 3,906,131 | A | 9/1975 | Böe |
| 3,940,917 | A | 3/1976 | Strachan |
| 3,961,125 | A | 6/1976 | Suminokura et al. |
| 3,989,870 | A | 11/1976 | Bocks et al. |
| 4,316,931 | A | 2/1982 | Tischer et al. |
| 4,341,213 | A | 7/1982 | Cohen |
| 4,379,189 | A | 4/1983 | Platt |
| 4,382,111 | A | 5/1983 | Kuwayama et al. |

(Continued)

FOREIGN PATENT DOCUMENTS

| | | |
|---|---|---|
| CH | 612 818 | 8/1979 |

(Continued)

OTHER PUBLICATIONS

European Search Report; EP 04 25 4668; The Hague; Nov. 3, 2004; P. VanGelder.

(Continued)

*Primary Examiner*—Frederick J Parker
(74) *Attorney, Agent, or Firm*—Fish & Richardson P.C.

(57) ABSTRACT

A method of forming a composite fabric article includes interlacing yarns including multi-filament fibers to form a fabric body of knit construction, and forming a raised or fleece region upon an inner surface of the fabric body. The method also includes applying a non-continuous coating consisting of discrete coating segments of coating material upon yarn fibers at an outer surface of the fabric body to bind individual yarn fibers together in bound groupings and to enhance abrasion resistance of the outer surface. The non-continuous coating is applied such that the coating is without substantial effect on hand tactile and breathability of the knit construction of the fabric body.

18 Claims, 1 Drawing Sheet

U.S. PATENT DOCUMENTS

| | | | | |
|---|---|---|---|---|
| 4,433,439 | A | | 2/1984 | Sidman et al. |
| 4,636,423 | A | * | 1/1987 | Reid ..... 428/196 |
| 4,923,555 | A | | 5/1990 | Elliott et al. |
| 5,126,182 | A | | 6/1992 | Lumb et al. |
| 5,171,633 | A | | 12/1992 | Muramoto |
| 5,198,288 | A | | 3/1993 | Grunfeld |
| 5,204,156 | A | | 4/1993 | Lumb et al. |
| 5,268,212 | A | | 12/1993 | Lumb et al. |
| 5,352,518 | A | | 10/1994 | Muramoto et al. |
| 5,364,678 | A | | 11/1994 | Lumb et al. |
| 5,389,430 | A | | 2/1995 | Yilgör et al. |
| 5,413,837 | A | | 5/1995 | Rock et al. |
| 5,456,960 | A | | 10/1995 | Ido et al. |
| 5,626,949 | A | * | 5/1997 | Blauer et al. ..... 428/196 |
| 5,756,180 | A | | 5/1998 | Squires et al. |
| 5,789,058 | A | | 8/1998 | Usher et al. |
| 5,804,011 | A | | 9/1998 | Dutta et al. |
| 5,855,125 | A | * | 1/1999 | Lohmueller et al. ..... 66/196 |
| 5,896,758 | A | | 4/1999 | Rock et al. |
| 5,922,433 | A | | 7/1999 | Scherbel |
| 6,082,147 | A | | 7/2000 | Rock et al. |
| 6,111,233 | A | | 8/2000 | Rock et al. |
| 6,238,789 | B1 | | 5/2001 | Jackson |
| 6,439,002 | B1 | | 8/2002 | Driggars |
| 6,524,978 | B1 | | 2/2003 | Moore |
| 2001/0046580 | A1 | | 11/2001 | Rock et al. |
| 2002/0025747 | A1 | | 2/2002 | Rock et al. |
| 2002/0122914 | A1 | | 9/2002 | Rock et al. |
| 2003/0221301 | A1 | | 12/2003 | Marg et al. |

FOREIGN PATENT DOCUMENTS

| | | | |
|---|---|---|---|
| DE | 30 43 433 | | 7/1982 |
| DE | 35 33 535 | | 4/1987 |
| EP | 0 515 206 | | 11/1992 |
| EP | 0 969 130 | | 1/2000 |
| GB | 1 420 497 | | 1/1976 |
| WO | 01/12889 | * | 2/2001 |

OTHER PUBLICATIONS

U.S. Appl. No. 10/700,405, filed Nov. 4, 2003.
U.S. Appl. No. 11/267,767, filed Nov. 4, 2005.
U.S. Appl. No. 10/911,855, filed Aug. 5, 2004.
Transaction History from Pair, (PTO Website), for U.S. Appl. No. 11/267,767, dated Mar. 31, 2009.
Transaction History from Pair, (PTO Website), for U.S. Appl. No. 10/911,855, dated Mar. 31, 2009.
Transaction History from Pair, (PTO Website), for U.S. Appl. No. 10/700,405, dated Mar. 31, 2009.

* cited by examiner

COMPOSITE FABRIC WITH ENGINEERED PATTERN

TECHNICAL FIELD

This application is a division of U.S. application Ser. No. 10/700,405, filed Nov. 4, 2003, now pending. The complete disclosure of the application is incorporated herein by reference.

This disclosure relates to fabric, and more particularly to composite fabrics.

BACKGROUND

Recently, there has been much interest in altering the properties of knit fabrics for added comfort. For example, velour fabrics having opposite fleece or raised surfaces are known to have good insulation performance under static conditions, i.e., in calm or still air with no wind blowing through the fabric. However, as conditions become more dynamic, the insulating performance of these articles drops rapidly. As a result, a wearer will often find it necessary to wear a continuous shell of low permeability. However, such continuous shells do not facilitate moisture vapor transmission in either dynamic or static conditions.

Composite fabric articles are achieved by joining at least one material to a fabric body to attain desirable properties that cannot be attained by the fabric body alone. Laminar composites, for example, having multiple layers joined by an adhesive are sometimes employed to increase the thermal resistance of a fabric body.

SUMMARY

One aspect of the disclosure features a composite fabric article comprising multi-filament, interlaced yarns forming a fabric body of knit construction. The fabric body has an inner surface and an outer surface where the inner surface has at least one region of raised fibers or fleece formed thereupon, and the outer surface has an area upon which a non-continuous coating of discrete coating segments is applied. The non-continuous coating binds individual yarn fibers together in bound groupings and enhances the abrasion resistance of the outer surface.

In some implementations, the non-continuous coating is without substantial effect on the insulation performance or moisture transmission rate provided by the knit construction of the fabric body.

In certain implementations, portions of the outer surface adjacent coating segments within the coated area of the outer surface are substantially free of coating material. In some cases, the non-continuous coating is disposed in a discrete area of the outer surface and an other area of the outer surface adjacent the discrete area is substantially free of coating material. In some implementations, the non-continuous coating is disposed in a discrete area of the outer surface and a continuous coating is applied in an other area of the outer surface. In these implementations, the area of continuous coating can be adjacent the discrete area of non-continuous coating.

Where the non-continuous coating is disposed within a discrete area, the discrete area and other areas can have differing resistances to abrasion, pilling and/or the areas can have contrasting air permeability. In some implementations, the coating material binds yarn fiber to protect the yarn fiber from fraying to enhance the pilling resistance within the coated portion of the fabric body. In some cases, the bound groupings of yarn fibers have a higher tenacity (e.g., greater than about 5 grams per denier) than individual yarn fibers.

In some implementations the yarn fiber is formed of polyester.

Some implementations have coating segments in the form of discrete dots. The coating material can be selected from acrylic latex, polyurethane and silicone. In some cases, the coating material forming the non-continuous coating is applied with a single head rotary screen, such as a rotary screen having between about 30 to about 195 holes per lineal inch. In some implementations, from about 0.5 to about 6.0 ounces per square yard of coating material is applied to form the non-continuous coating, such as about 1.7 ounces per square yard.

In some implementations, the knit construction is formed by reverse plaited circular knitting. In these implementations, stitch yarn of the knit construction can be coarser than the loop yarn. In some cases, the loop yarn is at most about 1.5 dpf. In certain cases, the stitch yarn is at least about 1.5 dpf.

In some implementations, the knit construction is formed by double needle bar warp knitting. In these implementations, the pile yarn can be at most about 5 dpf.

In some cases, the knit construction is formed by non-reverse plaited circular knitting. In some of these cases, stitch yarn is coarser than loop yarn. In other cases, the knit construction is Raschel warp knit.

In some implementations, yarn at the outer surface includes extensible material. The extensible material can be in the form of an extensible yarn that is added to the yarn at the outer surface in plaited form. The extensible material can be in the form of an extensible yarn that is wound about the yarn at the outer surface. The extensible material can be added to the yarn at the outer surface in air cover.

In some implementations, yarn at the outer surface includes a cored yarn that has a core and a sheath. The core of the cored yarn can be an extensible material.

In certain cases, the non-continuous coating is disposed on substantially the entire outer surface such that, as applied, areas of the fabric body at the outer surface adjacent coating segments are substantially free of coating material to allow air passage through those areas.

The composite fabric can be in the form of an article of wearing apparel, such as a pant or a jacket. Areas in which the non-continuous coating is applied can correspond to an area of wearing apparel typically subjected to relatively high levels of abrasion or pilling during use, such as the shoulders and/or elbows of a jacket or shirt.

In another aspect, the disclosure features a method of forming a fabric article. The method includes interlacing yarns comprising multi-filament fibers to form a fabric body of knit construction; forming a raised or fleece region upon an inner surface of the fabric body; and applying a non-continuous coating of discrete coating segments of coating material upon yarn fibers at an outer surface of the fabric body to bind individual yarn fibers together in bound groupings and to enhance abrasion resistance of the outer surface.

In some implementations, the step of forming a fleece or raised region includes at least one of napping, sanding and brushing. The step of forming a fleece or raised region can occur prior or subsequent to applying the non-continuous coating.

In certain implementations, the non-continuous coating is applied within a discrete area of the outer surface. In come cases, this discrete area corresponds to an area of the outer surface typically subjected to relatively high levels of pilling or abrasion during use. In some implementations, a continuous coating is applied in an area of the outer surface other than the area in which the non-continuous coating is applied. In some cases, an area other than the discrete area in which the non-continuous coating is applied is substantially free of coating material.

In some cases, the step of applying a non-continuous coating of discrete coating segments of coating material upon yarn fibers at an outer surface of the fabric body to bind individual yarn fibers together in bound groupings protects the fibers from fraying corresponding to an increase in pilling resistance.

In some implementations, the discrete segments of coating material are in the form of dots. The non-continuous coating can be applied with one of rotary printing, kiss rolling and gravure rolling. In some cases, the coating material forming the non-continuous coating is applied with a single head rotary screen, such as a rotary screen having between about 30 to about 195 holes per lineal inch. In some implementations, from about 0.5 to about 6.0 ounces per square yard of coating material is applied to form the non-continuous coating, such as about 1.7 ounces per square yard. Any of double needle bar warp knitting, Raschel warp knitting, reverse plaited circular knitting, non-reverse plaited circular knitting can be used to interlace the yarns.

In certain implementations, the non-continuous coating is applied such that the coating is without substantial effect on the insulation performance provided by the knit construction of the fabric body and/or the moisture vapor transmission rate provided by the knit construction of the fabric body.

The disclosure provides a composite fabric article that overcomes deficiencies of fabrics, in particular when used in garments and other articles for harsher outdoor sports, without detracting significantly from qualities of the original form of the fabric found highly desirable for use during exercise or exertion, e.g., warmth, breathability, drapability, MVT, hand tactile, etc.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
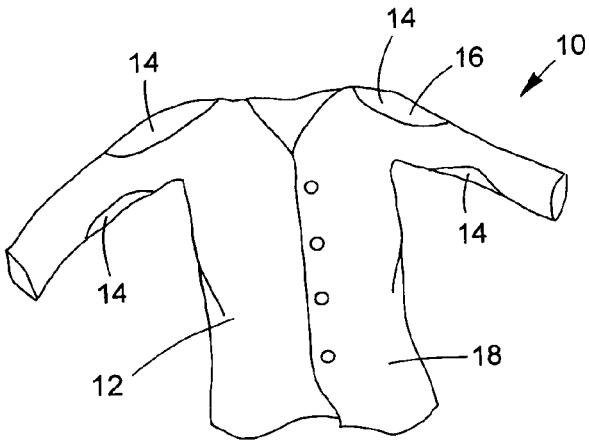
FIG. 1 illustrates an implementation of a fabric article in the form of a jacket.
Figure 2:
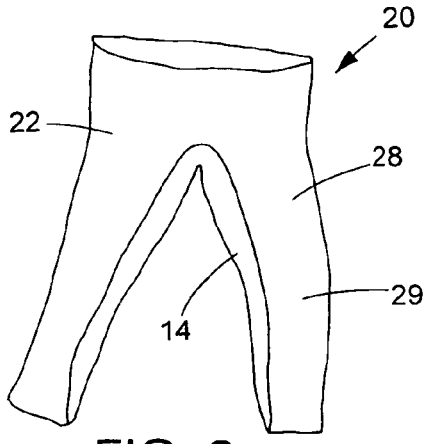
FIG. 2 illustrates another implementation of a fabric article in the form of a pant.

Referring to FIGS. 1 and 2, knit fabric articles 10, 20 of wearing apparel in the form of, by way of examples only, a jacket and pant are formed of an improved composite fabric having controlled air permeability to enhance dynamic insulation and to reduce convective heat loss. The fabrics have relatively smooth outer surfaces 12, 22 upon which non-continuous coatings 14, 24 are adhered and inner surfaces upon which a raised or insulating fleece is formed. Non-continuous coatings 14, 24 enhance face abrasion resistance and pilling resistance of the resulting fabrics while generating controlled air permeability in a predetermined range to facilitate improved levels moisture vapor transmission (MVT), which is particularly desirable for activities generating high metabolism rates.

Generally, non-continuous coating 14 can be applied to areas of the outer surface of the fabric article, as desired. Referring particularly to FIG. 1, in a first example, fabric article 10 has areas 16 of non-continuous coating and areas 18 free of coating. Areas 16 correspond to regions of finished fabric article 10 that are more prone to abrasion and pilling during use. By applying non-continuous coating to these areas of the outer surface, areas 16 exhibit higher levels of abrasion and pilling resistance than areas 18. Areas 18, being substantially free of coating material, have a relatively higher level of air permeability and facilitate a higher moisture vapor transmission rate. As shown, coating 14 is applied to areas corresponding to the shoulders and elbows.

In another example, referring to FIG. 2, fabric article 20 has areas 26 of non-continuous coating and areas 28 of a continuous coating 29. Non-continuous coating 14 is applied within areas 26 of fabric article 10 corresponding to regions of finished fabric article 10 that are subjected to relatively high perspiration levels during use. Areas 28 having the continuous coating applied to the outer surface have higher abrasion and pilling resistances and lower air permeability levels. Non-continuous coating 14, by being applied in areas 26, facilitates moisture vapor transmission while enhancing the abrasion and pilling resistances. As shown, coating 14 is applied to areas corresponding to the inner thighs.

As a third example (not shown), the non-continuous coating is applied in areas of the fabric article subjected to relatively high levels of wind impact (e.g., the chest of a shirt or jacket). Areas having the non-continuous coating have improved wind resistance due to the selected application of the coating material.

Figure 3:
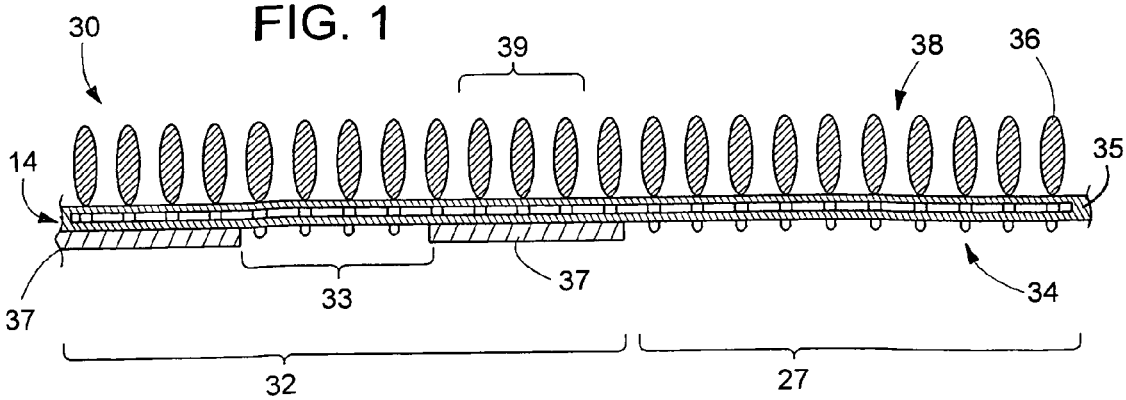
FIG. 3 is a diagrammatic section view of a knit fabric prebody of a first implementation having a non-continuous coating.

Referring to FIG. 3, knit fabric prebody 30, for use in forming fabric articles, such as those depicted by FIGS. 1 and 2, includes non-continuous coating 14 formed of multiple, spaced apart or discontinuous coating segments 37 applied within an area 32 of technical face 34. As noted briefly above, in some implementations, non-continuous coating 14 is applied to only portions of knit fabric prebody 30 leaving area 27 substantially free of non-continuous coating 14. In some cases, area 27 has a continuous coating applied thereon. As used herein, the term "fabric prebody" is employed to distinguish the fabric body formed by later process steps. The terms "technical face" and "technical back" generally refer to sides of the fabric as it exits the knitting machine. As used herein, the term technical face also refers to the outer surface of the finished fabric article (see elements 12, 22 of FIGS. 1 and 2).

Coating 14 is non-continuous within area 32 of technical face 34 and is applied in a predetermined pattern (e.g., lines, dots) leaving portion 33 of the technical face free of the coating material within area 32 adjacent coating segments 37. The coating material forming coating segments 37 is generally air impermeable or semi impermeable, while within portion 33, the fabric prebody remains air permeable to allow air passage through the composite fabric at controlled rates, the details of which is further described below.

In addition to providing controlled air permeability, the coating material binds yarn fibers improving other certain structural and physical properties of the composite fabric. For example, in binding the individual fibers using the coating material, the fibers form bound fiber groupings (e.g., of at least about 5 fibers, of at least about 20 fibers, of at least about 35 fibers, of at least about 70 fibers, from about 2 to about 100 fibers) and the tenacity of these groupings of fibers (e.g., from about 140 to about 350 grams per denier for a grouping of about 70 fibers) is greater than the tenacity of each individual fiber (e.g., from about 2 to about 5 grams per denier). Also, by coating and binding yarn fibers together with coating material within region 32, the abrasion and pilling resistances within the region is improved, thus improving the abrasion and pilling resistances of the composite fabric.

Pilling resistance within coated regions 32 of the composite fabric can be as high as five on a scale from one to five measured by ASTM D-3512. Face abrasion resistance of the composite fabric within coated regions 32 can be as high as five on a scale from one to five after 250 cycles measured by ASTM D-3884 and using a Martindale abrasion machine where the abrasion is done by a VELCRO® hook touch fastener tape mounted on the Martindale testing unit.

In binding fibers of the yarn, non-continuous coating 14 also provides greater freedom of yarn selection in the construction of the fabric prebody. In some implementations, coating 14 facilitates use of relatively finer fibers (e.g., less than 5.0 dpf, less than 1 dpf, less than 0.5 dpf, less than 0.2 dpf, from about 0.1 dpf to about 5.0 dpf) in the construction of the prebody, e.g., by reducing the risk of the fibers being pulled from the technical face. By utilizing finer fibers, a tighter stitch can be achieved which, in turn, improves the dynamic insulating performance of the resultant fabric by, e.g., providing relatively narrow air passageways through the fabric and increasing the tortuosity through those passageways. In certain implementations, non-continuous coating 14, in binding fibers in the yarn of fabric prebody 30, allows use of relatively weaker fibers, such as polyester and nylon in the construction of the prebody, which also provides greater tortuosity of air passageways to enhance dynamic insulation performance of the fabric.

A variety of coating materials can be used such as acrylic including acrylic latex, polyurethane and silicone. The amount of coating material applied depends, at least in part, on the end use of the product. For example, in some cases, it may be desirable to greatly enhance the abrasion resistance of areas of the fabric article. In these cases, relatively more coating material can be applied (e.g., more dots per square inch of fabric material and/or more material per dot). In other cases, it may be desirable for areas of the fabric article to have enhanced abrasion resistance, while having a relatively high level of air permeability. In these cases, relatively less coating material can be applied (e.g., less dots per square inch of material and/or less material per dot). The weight of non-continuous coating 14 on the printed fabric can be between about 0.5 to about 6.0 oz/sq yd, such as about 1.7 oz/sq yd. Non-continuous coating 14 can be applied by any suitable method including, e.g., rotary printing, kiss rolling, and gravure rolling. In some cases, non-continuous coating 14 is applied by a single head rotary screen having a selected number of holes per lineal inch (e.g., from about 30 holes per lineal inch to about 195 holes per lineal inch).

In a first example of a fabric article construction, referring particularly to FIG. 3, a knit fabric prebody 30 is formed by joining a stitch yarn 35 and a loop yarn 36 in a standard reverse plaiting circular knitting (terry knitting) process, e.g., as described in *Knitting Technology*, by David J. Spencer (Woodhead Publishing Limited, 2nd edition, 1996), the entire disclosure of which is incorporated herein by reference. In the terry knitting process, the stitch yarn 35 forms the technical face 34 of the resulting fabric prebody 30 and the loop yarn 36 forms the opposite technical back 38, where it is formed into loops 39. In the fabric prebody 30, the loop yarn 36 extends outwardly to overlie and cover the stitch yarn 35 at the technical face 34.

The loop yarn 36 forming the technical back 38 of the knit fabric body 30 can be made of any synthetic or natural material. The cross section and luster of the fibers or the filament may be varied, e.g., as dictated by requirements of the intended end use. The loop yarn 16 can be a textured or flat filament yarn, with a textured yarn being preferred. In some implementations, the loop yarn has a relatively finer dpf (e.g., at most about 0.2 to about 1.5 dpf) than the stitch yarn (e.g., about 2.0 dpf), allowing a tighter stitch (e.g., using a 235" per revolution, 28 cut, 26" cylinder knitting machine) for greater dynamic insulating effect. The loop yarn overall denier is preferably in the range of about 70 denier to 300 denier, such as about 150 denier. At the preferred count, the filament count range is from about 100 filaments to about 400 filaments. A preferred commercial loop yarn is a 2/70/200 filament with a dpf of 0.3, e.g., as available from Unifi Inc.

The stitch yarn 14 forming the technical face 16 of the knit fabric body 12 can be also made of any type of synthetic or natural material in a textured or flat micro-denier filament yarn, with a textured yarn being preferred. In preferred implementations, stitch yarn 35 is coarser (e.g., at least about 1.5 dpf, such as about 2.0 dpf) than loop yarn 36, as noted above. The range of stitch yarn count overall denier is preferably between about 50 denier to 150 denier. At the preferred count, the filament count range is from about 24 filaments to about 100 filaments. A preferred stitch yarn is 70/34, e.g. as available commercially from Unifi Inc.

In another example, the fabric upon which a surface of enhanced durability is to be formed has a warp knit construction, e.g. as described in U.S. Pat. No. 6,196,032, issued Mar. 6, 2001, and U.S. Pat. No. 6,199,410, issued Mar. 13, 2001, the complete disclosures of which are incorporated herein by reference. Still other examples of suitable processes for forming the fabric prebody with inherent wind breaking properties include circular knit with perfect plaiting and double needle bar warp knit, both of which are described in, e.g., *Knitting Technology*. Coating 14 can be applied to both wind resistant and non wind resistant constructions to enhance pilling and abrasion resistances.

In any of the above knit constructions, elastic yarn may be added (e.g., spandex such as Lycra® or Lycra® T-400) to, e.g., the stitch yarn. In some cases, stitch yarn is formed of elastic material. In certain cases, elastomeric yarn can be wound about the stitch yarn and/or the elastomeric yarn can be added to the stitch yarn in plaited form and/or air cover. In some implementations, stitch yarn may include an elastic core yarn. The elastomeric materials in the stitch yarn can provide relatively greater densification and tortuosity, and therefore increased dynamic insulation performance for enhanced protection from wind penetration, as well as providing for fabric stretch and enhanced wearer comfort.

Figure 4:
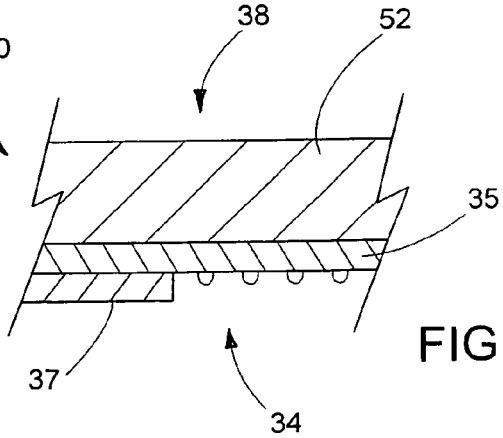
FIG. 4 is a diagrammatic section view of a knit fabric body formed by finishing the fabric prebody of FIG. 3.

Once the fabric prebody is formed, referring to FIG. 4, fabric prebody 30 (FIG. 3) is subjected to finishing to form fabric body 50. During the finishing process, the technical back 38, of fabric prebody 30, goes through a finishing process such as sanding, brushing and/or napping, to generate a raised surface 52, such as a fleece or velour, as examples. Raised surface 52 can be finished to a predetermined height depending on the application for which the composite fabric will ultimately be used. Controlling the height of raised surfaces 52 allows for different levels of insulation to be generated. Typically, the greater the height of the raised surface, the more insulation the fabric will provide. In some cases, fabric prebody 30 may be finished prior to application of non-continuous coating 14. Fabric prebody 30 may also be treated, e.g., chemically, to make it hydrophobic.

After finishing, fabric body 50 is heat set to stabilize the fabric article width. Heat may be applied to the fabric body, e.g. dry heat or wet heat, such as hot water or steam, e.g. during finishing or dyeing. This can be done before and/or after the coating is deposited.

As indicated briefly above, some implementations of the composite fabric article, while exhibiting improved abrasion and pilling resistances, can also allow water vapor transmission with relatively little change in insulating performance, particularly at higher wind velocities (e.g., greater than five miles per hour). This is due to less interference by the non-continuous coating (e.g., compared to a continuous coating of an impermeable or semi impermeable material) with the insulation performance and air permeability resulting from certain fabric body constructions. Thus, moisture can be transported from a wearer's body, thereby improving the wearer's comfort level, without affecting the warmth of the fabric significantly.

Examples of suitable knit constructions upon which the non-continuous coating can be applied will now be described:

EXAMPLE I

Plaited Knit Construction

Loop yarn: 70/48 tx polyester
Stitch yarn: 70/72 tx polyester (technical face)
Spandex (plaited with stitch yarn): 55 denier Dorlastan
2.4 cut (gauge), 26 cylinder
Stitch meter: 295" per revolution.

EXAMPLE II

Plaited Knit Construction

Loop yarn: 70/72 tx polyester
Stitch yarn: 70/72 tx polyester (technical face)
Spandex (plaited with stitch yarn): 70 denier Dorlastan
24 cut (gauge), 26" cylinder
Stitch meter: 275" per revolution.

EXAMPLE III

Reverse Plaiting Knit Construction

Loop yarn: 150/136 tx polyester
Stitch yarn: 100/36 tx polyester (technical face)
28 cut (gauge), 26" cylinder
Stitch meter: 250" per revolution.

EXAMPLE IV

Double Needle Bar Warp Knit Construction

Pile: 150/68 tx polyester
Backing: 2/150/132 tx polyester (technical face)
Stitch yarn: 100/34 tx polyester
16 gauge machine.

A number of implementations of the disclosure have been described. Nevertheless, it will be understood that various modifications may be made without departing from the spirit and scope of the disclosure. Accordingly, other implementations are within the scope of the following claims.

What is claimed is:

1. A method of forming a fabric article, said method comprising the steps of:

interlacing yarns comprising multi-filament fibers to form a fabric body of knit construction;

forming a raised or fleece region upon an inner surface of the fabric body; and applying a non-continuous coating in a predetermined and repeating pattern comprising discrete coating segments of between about 0.5 to about 6.0 ounces per square yard of coating material selected from a group consisting of acrylic latex, polyurethane and silicone with a single head rotary screen having from about 30 to about 195 holes per lineal inch upon yarn fibers at an outer surface of the fabric body such that the non-continuous coating is without substantial effect on hand tactile and breathability of the knit construction of the fabric body, thereby to bind individual yarn fibers together in bound groupings and to enhance abrasion resistance of the outer surface.

2. The method of claim 1, wherein the step of forming a fleece or raised region includes at least one selected from a group consisting of napping, sanding and brushing.

3. The method of claim 2, wherein the step of forming a fleece or raised region occurs prior to applying the non-continuous coating.

4. The method of claim 2, wherein the step of forming a fleece or raised region occurs subsequent to applying the non-continuous coating.

5. The method of claim 1, wherein the step of applying a non-continuous coating comprises applying the non-continuous coating in a discrete area of the outer surface.

6. The method of claim 5, wherein said discrete area corresponds to an area of the outer surface typically subjected to relatively high levels of pilling or abrasion during use.

7. The method of claim 5 further comprising applying a continuous coating in an area of the outer surface other than said discrete area.

8. The method of claim 5, wherein an area other than said discrete area is substantially free of coating material.

9. The method of claim 1, wherein the step of applying a non-continuous coating comprising discrete coating segments of coating material upon yarn fibers at an outer surface of the fabric body to bind individual yarn fibers together in bound groupings protects the fibers from fraying corresponding to an increase in pilling resistance.

10. The method of claim 1, wherein the discrete segments of coating material are in the form of dots.

11. The method of claim 1, wherein the step of interlacing yarns comprises double needle bar warp knitting.

12. The method of claim 1, wherein the step of interlacing yams comprises Raschel warp knitting.

13. The method of claim 1, wherein the step of interlacing yarns comprises reverse plaited circular knitting.

14. The method of claim 1, wherein the step of interlacing yams comprises non reverse plaited knitting.

15. The method of claim 1, wherein the non-continuous coating is applied such that the non-continuous coating is without substantial effect on insulation performance provided by the knit construction of the fabric body.

16. The method of claim 1, wherein the non-continuous coating is applied such that the non-continuous coating is without substantial adverse effect on moisture vapor transmission rate provided by the knit construction of the fabric body.

17. The method of claim 1, wherein about 1.7 ounces per square yard of coating material is applied to form the non-continuous coating.

18. A method of forming a fabric article, said method comprising the steps of:

interlacing yarns comprising multi-filament fibers to form a fabric body of knit construction;

forming a raised or fleece region upon an inner surface of the fabric body; and applying a non-continuous coating in a predetermined and repeating pattern comprising discrete coating segments of between about 0.5 to about 6.0 ounces per square yard of coating material selected from a group consisting of acrylic latex, polyurethane and silicone with a single head rotary screen having from about 30 to about 195 holes per lineal inch upon yarn fibers at an outer surface of the fabric body such that the non-continuous coating is without substantial effect on hand tactile and breathability of the knit construction of the fabric body, and such that the one or more discrete areas including the non-continuous coating have a pilling resistance of five on a scale from one to five, as measured by ASTM D-3512.

* * * * *

UNITED STATES PATENT AND TRADEMARK OFFICE

CERTIFICATE OF CORRECTION

PATENT NO. : 7,579,045 B2
APPLICATION NO. : 11/236247
DATED : August 25, 2009
INVENTOR(S) : Moshe Rock et al.

It is certified that error appears in the above-identified patent and that said Letters Patent is hereby corrected as shown below:

Col. 1, line 4, delete "TECHNICAL FIELD" and insert -- CROSS REFERENCE TO RELATED APPLICATIONS --.

Col. 1, line 9, insert sub heading -- TECHNICAL FIELD --.

Col. 8, claim 12, line 49, delete "yams" and insert -- yarns --.

Col. 8, claim 14, line 53, delete "yams" and insert -- yarns --.

Signed and Sealed this

Thirteenth Day of October, 2009

David J. Kappos

David J. Kappos
*Director of the United States Patent and Trademark Office*